US012678683B2

(12) United States Patent
Mo

(10) Patent No.: US 12,678,683 B2
(45) Date of Patent: Jul. 14, 2026

(54) LOWER LEG GUARD FOR SPORTS TRAINING

(71) Applicant: Dongguan Xinwangda Outdoor Products Co., Ltd., Dongguan (CN)

(72) Inventor: Mengru Mo, Hezhou (CN)

(73) Assignee: Dongguan Xinwangda Outdoor Products Co., Ltd., Dongguan (CN)

( * ) Notice: Subject to any disclaimer, the term of this patent is extended or adjusted under 35 U.S.C. 154(b) by 0 days.

(21) Appl. No.: 18/800,066

(22) Filed: Aug. 11, 2024

(65) Prior Publication Data

US 2026/0027444 A1 Jan. 29, 2026

(30) Foreign Application Priority Data

Jul. 24, 2024 (CN) ..... 202421759953.1

(51) Int. Cl.
*A63B 71/12* (2006.01)

(52) U.S. Cl.
CPC .. *A63B 71/1225* (2013.01); *A63B 2071/1258* (2013.01)

(58) Field of Classification Search
CPC ..... A63B 71/1225; A63B 2071/1258; A61F 5/0585
See application file for complete search history.

(56) References Cited

U.S. PATENT DOCUMENTS

| | | | | |
|---|---|---|---|---|
| 3,074,405 | A * | 1/1963 | Duensing | A61F 7/02 2/22 |
| 10,231,882 | B2 * | 3/2019 | Cox | A61F 5/30 |
| 2003/0077407 | A1 * | 4/2003 | Chang | A41D 13/065 428/34.1 |
| 2009/0113593 | A1 * | 5/2009 | Mastronardi | A41D 13/0543 2/22 |
| 2009/0235421 | A1 * | 9/2009 | Sash | A63B 71/1225 2/22 |
| 2012/0204324 | A1 * | 8/2012 | Flieshman | A41D 17/02 2/241 |
| 2021/0137184 | A1 * | 5/2021 | Abram | B32B 27/30 |

* cited by examiner

*Primary Examiner* — Alissa L Hoey
*Assistant Examiner* — Akwokwo Olabisi Redhead

(57) ABSTRACT

Disclosed is a lower leg guard for sports training, and belongs to the technical field of sports protectors. The lower leg guard for sports training includes a sheath, and the sheath is axially C-shaped. The lower leg guard for sports training further includes a contraction zone arranged on the sheath, the contraction zone is mounted at an opening of the sheath, and a conical tubular space is enclosed between the sheath and the contraction zone. The lower leg guard for sports training further includes a support part arranged on the sheath, the support part is mounted in a middle area of a surface of the sheath. Through the sheath, the connecting surfaces, the elastic band, and the fasteners that match each other, the present disclosure improves the training effect of the athlete.

5 Claims, 6 Drawing Sheets

LOWER LEG GUARD FOR SPORTS TRAINING

TECHNICAL FIELD

The present disclosure relates to the technical field of sports protectors, and particularly relates to a lower leg guard for sports training.

BACKGROUND

Sports refer to various conscious activities gradually carried out in the process of human development to improve physical fitness, involving various forms of body movements such as walking, running, jumping, throwing, and dancing. These activities, commonly known as physical exercises, are rich in forms and contents, relating to various sports disciplines such as track and field, balls, aerobics, weightlifting and the like.

At present, in the process of sports training, athletes of running, basketball, soccer and the like usually undergo high intensity training. The lower leg is one of the parts of the human body that are vulnerable to injuries. Particularly during high-intensity exercise, the athletes are prone to injuries caused by lower leg muscle strains or collision, which adversely affects their training effect. Therefore, in order to solve the above problem, the present disclosure provides a lower leg guard for sports training.

SUMMARY

To solve the problem that the athletes are prone to injuries caused by lower leg muscle strains or collision in the training process at present, which adversely affects their training effect, the present disclosure provides a lower leg guard for sports training.

To achieve the above objective, the present disclosure adopts the following technical solution:

a lower leg guard for sports training, including a sheath, where the sheath is axially C-shaped, further including a contraction zone arranged on the sheath, where the contraction zone is mounted at an opening of the sheath, and a conical tubular space is enclosed between the sheath and the contraction zone; further including a support part arranged on the sheath, where the support part is mounted in a middle area of a surface of the sheath, and the support part and the contraction zone are arranged to be opposite to each other.

To ensure that the sheath is securely sleeved on an athlete's lower leg, preferably, the contraction zone includes two connecting surfaces, the two connecting surfaces are fixedly connected to both sides of the sheath respectively, an elastic band is fixedly connected between the two connecting surfaces, and fasteners are mounted on the connecting surface.

To improve the air permeability of a surface of the elastic band, a plurality of sets of ventilation holes are formed on the elastic band in a penetrating manner, and the plurality of sets of ventilation holes are linearly arranged on the surface of the elastic band.

To improve the toughness of the sheath, preferably, the support part includes a fixed surface fixedly connected to the sheath, and a support strip is embedded inside the fixed surface.

To improve safety of using the lower leg guard at night, further, a reflective layer is arranged on an outer surface of the fixed surface, and the reflective layer is made of reflective fibers.

To ensure the elasticity, air permeability and abrasion resistance of the sheath, preferably, the sheath includes an inner layer, an interlayer, and an outer layer, where the interlayer is arranged on a side of the inner layer, and the outer layer is arranged on a side of the interlayer away from the inner layer.

Compared with the prior art, the present disclosure provides a lower leg guard for sports training, and has the following beneficial effects:

1. Through the sheath, the connecting surfaces, the elastic band and the fasteners that match each other, the lower leg guard for sports training is capable of stably supporting and protecting an athlete's lower leg, reducing stress on the athlete's lower leg muscles and ligaments, and preventing injuries to the athlete caused by lower leg muscle strains or collision during training, thus helping to improve the training effect of the athlete.
2. Through the arrangement of the fixed surface and the support strip, the lower leg guard for sports training is capable of improving overall toughness of the sheath, thus enhancing the support effect of the sheath and further enhancing the protective effect on the lower leg guard.

The parts of the lower leg guard for sports training not mentioned herein are the same as the prior art or can be implemented by using the prior art. The present disclosure solves the problem that the athletes are prone to injuries caused by lower leg muscle strains or collision in the training process at present, which adversely affects their training effect.

Figure 1:
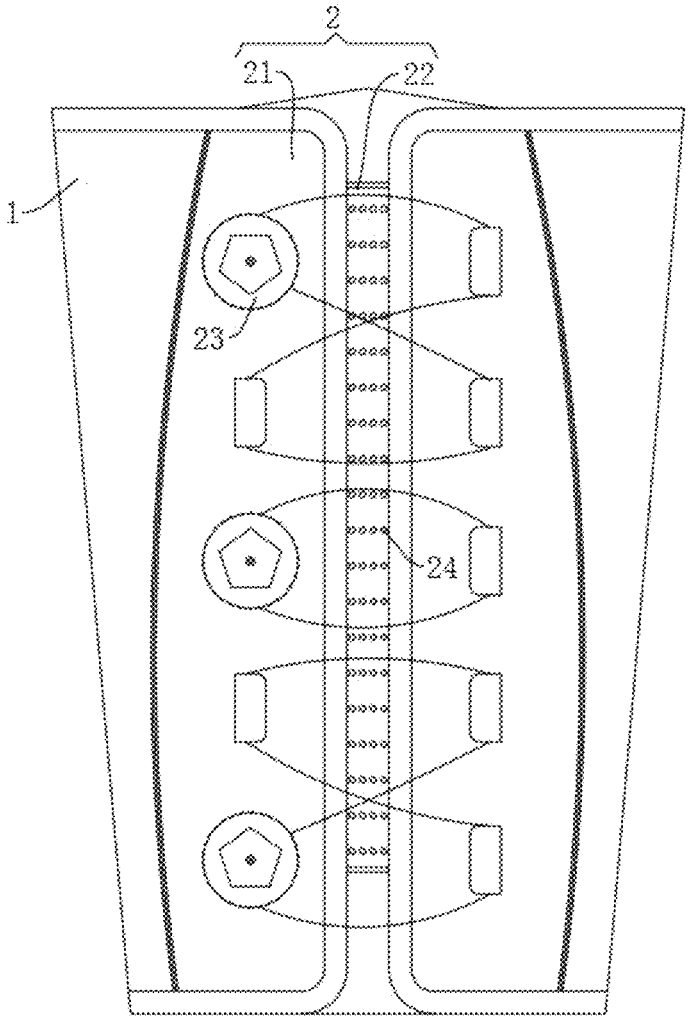
FIG. 1 is a structural schematic diagram of a front view of a lower leg guard for sports training provided in the present disclosure.

In the drawings, reference numerals are as follows. 1. Sheath; 2. Contraction zone; 21. Connecting surface; 22. Elastic band; 23. Fastener; 24. Ventilation hole; 3. Support part; 31. Fixed surface; 32. Support strip; 33. Reflective layer; 41. Inner layer; 42. Interlayer; 43. Outer layer; 231. Adjustment line; 232. Winding disc; 233. Line tube.

DETAILED DESCRIPTIONS OF THE EMBODIMENTS

The technical solutions in the embodiments of the present disclosure will be clearly and completely described below in combination with the accompanying drawings in the embodiments of the present disclosure. Apparently, the embodiments described are merely some rather than all of the embodiments of the present disclosure.

In the description of the present disclosure, it is to be understood that the terms "upper", "lower", "front", "rear", "left", "right", "top", "bottom", "inner", "outer", etc. indicate azimuthal or positional relations based on those shown in the drawings only for ease of description of the present disclosure and for simplicity of description, and are not intended to indicate or imply that the referenced device or element must have a particular orientation and be constructed and operative in a particular orientation, and thus may not be construed as a limitation on the present disclosure.

Embodiment

Figure 2:
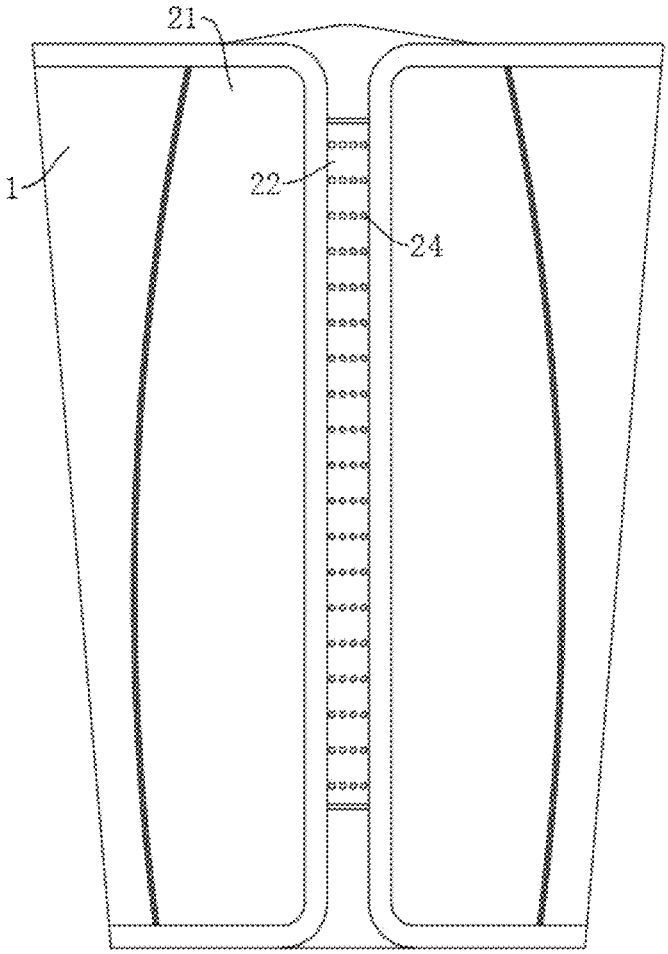
FIG. 2 is a structural schematic diagram of a partial front view of a lower leg guard for sports training provided in the present disclosure.
Figure 3:
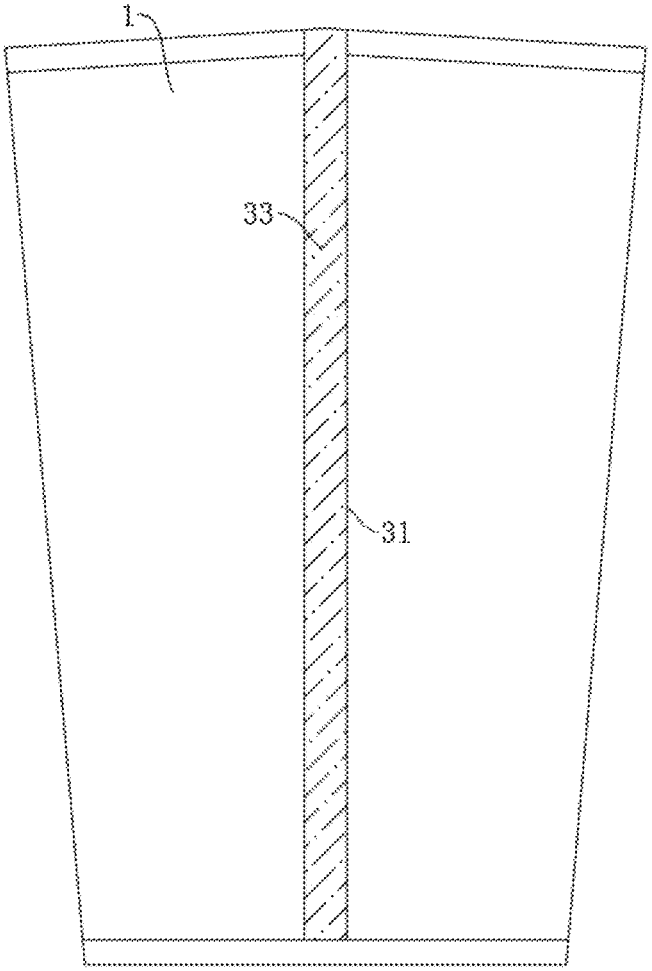
FIG. 3 is a structural schematic diagram of a rear view of a lower leg guard for sports training provided in the present disclosure.
Figure 4:
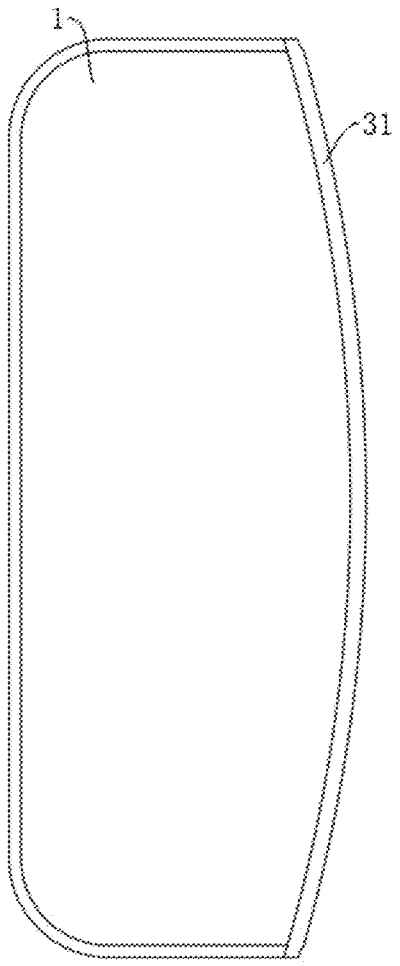
FIG. 4 is a structural schematic diagram of a side view of a sheath of a lower leg guard for sports training provided in the present disclosure.
Figure 5:
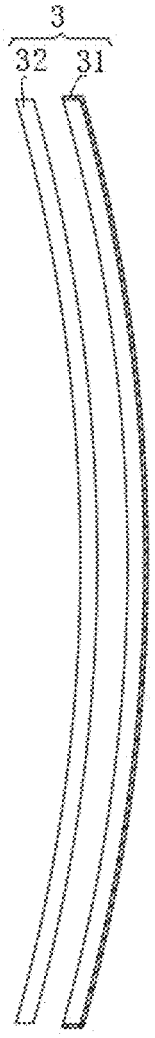
FIG. 5 is a partial exploded view of a lower leg guard for sports training provided in the present disclosure.
Figure 6:
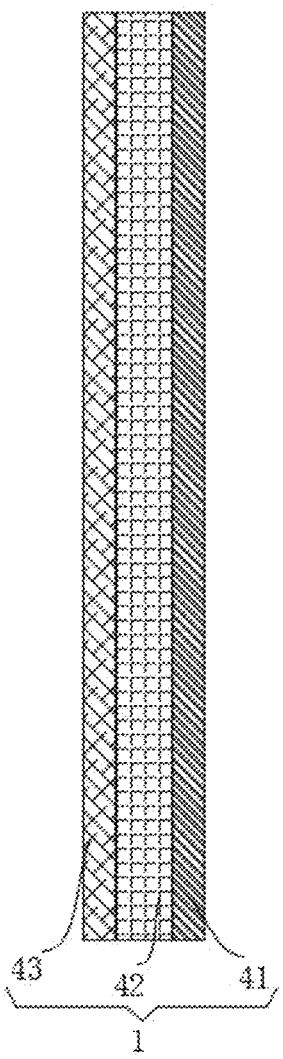
FIG. 6 is a schematic diagram of a laminate structure of a lower leg guard for sports training provided in the present disclosure.

With reference to FIGS. 1-6, in an embodiment of the present disclosure, there is provided a lower leg guard for sports training. The lower leg guard for sports training includes a sheath 1, and the sheath 1 is axially C-shaped. The lower leg guard for sports training further includes a contraction zone 2 arranged on the sheath 1, the contraction zone 2 is mounted at an opening of the sheath 1, and a conical tubular space is enclosed between the sheath 1 and the contraction zone 2. The lower leg guard for sports training further includes a support part 3 arranged on the sheath 1, the support part 3 is mounted in a middle area of a surface of the sheath 1, and the support part 3 and the contraction zone 2 are arranged to be opposite to each other.

In use, through the sheath 1, the contraction zone 2 and the support part 3 that match each other, the present disclosure is capable of stably supporting and protecting an athlete's lower leg, reducing stress on the athlete's lower leg muscles and ligaments, and preventing injuries to the athlete caused by lower leg muscle strains or collision during training, thus helping to improve the training effect of the athlete.

The contraction zone 2 includes two connecting surfaces 21, the two connecting surfaces 21 are fixedly connected to both sides of the sheath 1 respectively, an elastic band 22 is fixedly connected between the two connecting surfaces 21, and fasteners 23 are mounted on the connecting surface 21.

The fastener 23 includes a line tube, an adjustment line, and a winding disc, where an end of the adjustment line passes through the line tube and is fixedly connected to the winding disc. When the winding disc rotates, the adjustment line winds around the winding disc, so that a length of the adjustment line can be adjusted to securely sleeve the sheath 1 on the athlete's lower leg.

In use, through the connecting surfaces 21, the elastic band 22 and the fasteners 23 that match each other, the opening of the sheath 1 can be contracted to securely sleeve the sheath 1 on the athlete's lower leg and prevent the lower leg guard from falling off the athlete's lower leg.

A plurality of sets of ventilation holes 24 are formed on the elastic band 22 in a penetrating manner, the plurality of sets of ventilation holes 24 are linearly arranged on a surface of the elastic band 22, and the number of sets of ventilation holes 24 is preferably 19.

Specifically, through the arrangement of the ventilation holes 24, the present disclosure is capable of improve the air permeability of the surface of the elastic band 22, and facilitates use by athletes in a more comfortable manner.

The support part 3 includes a fixed surface 31 fixedly connected to the sheath 1, and a support strip 32 is embedded inside the fixed surface 31.

Through the arrangement of the connecting surfaces 21 and the support strip 32, the present disclosure is capable of improving overall toughness of the sheath 1, thus enhancing the support effect of the sheath 1 and further enhancing the protective effect on the lower leg guard.

A reflective layer 33 is arranged on an outer surface of the fixed surface 31, and the reflective layer 33 is made of reflective fibers.

Through the arrangement of the reflective layer 33, the present disclosure is capable of improving safety of using the lower leg guard in dark conditions at night.

The sheath 1 includes an inner layer 41, an interlayer 42, and an outer layer 43, where the interlayer 42 is arranged on a side of the inner layer 41, and the outer layer 43 is arranged on a side of the interlayer 42 away from the inner layer 41. The inner layer 41 is made of polyester, the interlayer 42 is made of cotton, and the outer layer 43 is made of nylon.

Specifically, this design ensures the elasticity, moisture absorption, air permeability and abrasion resistance of the sheath 1, thereby improving the use effect of the lower leg guard.

The lower leg guard for sports training can be used by an athlete as follows. The athlete first sleeves the sheath 1 on his/her lower leg, and then enables the two connecting surfaces 21 to move in opposite directions through the fasteners 23, to contract the opening of the sheath 1 and securely sleeve the sheath 1 on his/her lower leg. Through the sheath 1, the connecting surfaces 21, the elastic band 22 and the fasteners 23 that match each other, the present disclosure is capable of stably supporting and protecting an athlete's lower leg, reducing stress on the athlete's lower leg muscles and ligaments, and preventing injuries to the athlete caused by lower leg muscle strains or collision during training, thus helping to improve the training effect of the athlete.

The foregoing descriptions are merely preferred specific implementations of the present disclosure, and are not intended to limit the protection scope of the present disclosure. Any equivalent replacements or changes made by a person skilled in the art according to the technical solution of the present disclosure and the inventive concepts thereof within the technical scope disclosed in the present disclosure shall fall within the protection scope of the present disclosure.

What it claimed is:

1. A lower leg guard for sports training, comprising:

a sheath, the sheath being axially C-shaped;

a contraction zone disposed on the sheath, the contraction zone being mounted at an opening of the sheath so that a conical tubular space is defined between the sheath and the contraction zone; and, a support part disposed on the sheath, the support part being mounted in a middle area of a surface of the sheath, the support part and the contraction zone being arranged opposite to each other;

wherein the contraction zone comprises two connecting surfaces fixedly connected to respective opposite sides of the sheath, an elastic band fixedly connected between the two connecting surfaces, and a plurality of fasteners mounted on one of the two connecting surfaces; and, wherein each fastener comprises an adjustment line, a winding disc, and one or more line tubes, one end of the adjustment line being configured to pass through the line tubes and be fixedly connected to the winding disc, and at least one of the line tubes being disposed on a connecting surface different from the connecting surface on which the corresponding fastener is mounted.

2. The lower leg guard for sports training according to claim 1, wherein a plurality of sets of ventilation holes are formed on the elastic band in a penetrating manner, and the plurality of sets of ventilation holes are linearly arranged on a surface of the elastic band.

3. The lower leg guard for sports training according to claim 1, wherein the support part comprises a fixed surface fixedly connected to the sheath, and a support strip is embedded inside the fixed surface.

4. The lower leg guard for sports training according to claim 3, wherein a reflective layer is arranged on an outer surface of the fixed surface, and the reflective layer is made of reflective fibers.

5. The lower leg guard for sports training according to claim 1, wherein the sheath comprises an inner layer, an interlayer, and an outer layer, wherein the interlayer is arranged on a side of the inner layer, and the outer layer is arranged on a side of the interlayer away from the inner layer.

* * * * *